US008695870B2

(12) United States Patent
Etzel et al.

(10) Patent No.: US 8,695,870 B2
(45) Date of Patent: Apr. 15, 2014

(54) FOLDING BOX CUTOUT AND FOLDING BOX FOLDED THEREFROM

(75) Inventors: Frank Etzel, Stuttgart (DE); Holger Wingenfeld, Backnang (DE)

(73) Assignee: CD Cartondruck GmbH, Obersulm (DE)

( * ) Notice: Subject to any disclaimer, the term of this patent is extended or adjusted under 35 U.S.C. 154(b) by 0 days.

(21) Appl. No.: 13/695,949

(22) PCT Filed: Apr. 13, 2011

(86) PCT No.: PCT/DE2011/000400

§ 371 (c)(1),
(2), (4) Date: Dec. 13, 2012

(87) PCT Pub. No.: WO2011/137887

PCT Pub. Date: Nov. 10, 2011

(65) Prior Publication Data

US 2013/0075460 A1 Mar. 28, 2013

(30) Foreign Application Priority Data

May 3, 2010 (DE) ..... 20 2010 006 381 U

(51) Int. Cl.
*B65D 5/56* (2006.01)

(52) U.S. Cl.
USPC ..... 229/122.32; 229/930

(58) Field of Classification Search
USPC ..... 229/122.32, 122.33, 122.34, 930
See application file for complete search history.

(56) References Cited

U.S. PATENT DOCUMENTS

| | | | | | |
|---|---|---|---|---|---|
| 4,601,407 | A | * | 7/1986 | Gillard | 229/930 |
| 4,693,413 | A | * | 9/1987 | McFarland et al. | 229/122.32 |
| 5,131,541 | A | * | 7/1992 | Liebel | 229/939 |
| 5,215,248 | A | * | 6/1993 | Moser | 229/122.32 |
| 5,439,133 | A | * | 8/1995 | Stone | 229/122.32 |
| 6,015,084 | A | * | 1/2000 | Mathieu et al. | 229/122.32 |
| 6,138,903 | A | * | 10/2000 | Baker | 229/122.33 |
| 2009/0152337 | A1 | * | 6/2009 | Chandaria | 229/198.2 |
| 2009/0286663 | A1 | | 11/2009 | Little | |

FOREIGN PATENT DOCUMENTS

| | | | |
|---|---|---|---|
| DE | 20 2004 010230 | U1 | 9/2004 |
| DE | 20 2009 000529 | U1 | 3/2009 |
| FR | 1 410 362 | A | 9/1965 |

OTHER PUBLICATIONS

International Search Report mailed Aug. 19, 2011 for the corresponding PCT/DE2011/000400.

* cited by examiner

*Primary Examiner* — Gary Elkins
(74) *Attorney, Agent, or Firm* — Leason Ellis LLP.

(57) ABSTRACT

A folding box cutout has wall units that can be folded along the fold lines, a lid unit that can be folded about a lid folding line, and a bottom unit that can be folded about a bottom folding line. In the transport state, the folding box cutout is folded to form a flat folding box, which is filled and closed by the lid unit and the bottom unit. A corrugated cardboard unit lies against the inner wall of the wall units and is connected to the inner wall of the folding box cutout so that the folding box cutout and the corrugated cardboard unit form a unit that can be handled as one piece for folding it flat and for unfolding it. The corrugated cardboard unit is present on each inner wall of the wall units, particularly all around, after the flat folded folding box has been erected.

9 Claims, 10 Drawing Sheets

FOLDING BOX CUTOUT AND FOLDING BOX FOLDED THEREFROM

CROSS-REFERENCE TO RELATED PATENT APPLICATIONS

This application is a U.S. National Phase Application under 35 U.S.C. §371 of International Patent Application No. PCT/DE2011/000400, filed Apr. 13, 2011, and claims the benefit of German Patent Application No. 20 2010 006 381.7, filed May 3, 2010, all of which are incorporated by reference herein. The International Application was published in German on Nov. 10, 2011 as International Publication No. WO/2011/137887 under PCT Article 21(2).

FIELD OF THE INVENTION

The present invention relates to a folding box cutout comprising wall units that can be folded along fold lines, a lid unit that can be folded about a lid fold line, and a base unit that can be folded about a base fold line, wherein, in the transport state, the folding box cutout is folded to form a flat folding box, which can be erected, filled and closed by the lid unit and by the base unit, wherein a corrugated cardboard unit lies against the inner wall of the wall units and is connected, at least in some areas, to the inner wall of the folding box cutout, so that the folding box cutout and the corrugated cardboard unit form a unit that can be handled as one piece for folding flat/unfolding and the corrugated cardboard unit is present on each inner wall of the folding box, at least in some areas on the wall units, in particular peripherally, once the flat folded folding box has been erected.

Folding box cutouts of this type are used, inter alia, to form a folding box, which can receive a perfume bottle for example.

BACKGROUND OF THE INVENTION

With the known folding boxes, these are initially supplied folded flat to the filler, and are then erected and filled with the respective perfume bottle. A corrugated cardboard unit is slid in, either before the introduction of a product or together with the product, wherein this corrugated cardboard unit is used to protect the perfume bottle from damage. This method is very complex and time-consuming, wherein the corrugated cardboard unit sometimes cannot be inserted or can only be inserted at very great effort due to the lack of tolerances.

DE 20 2004 010 230 U1 discloses a packaging comprising a folding box having side walls, a lid and a base, wherein an inner frame, which is formed as a corrugated cardboard unit, is present on the inner face or inner wall of the wall units, wherein this inner frame has a broken edge design, which corresponds at the outer side to the broken edge design of the folding box. The inner frame or corrugated cardboard unit can be glued to the folding box cutout in this instance and can form a common cutout.

DE 20 2009 000 529 U1 discloses a folding box for receiving a group of containers, wherein an external packaging is used, which is provided internally with a lining. The external packaging preferably consists of kraft cardboard. A folding box of this type is preferably used for the packaging of bottles in what are known as "six-packs". The lining preferably consists of recycled cardboard. The lining has side walls, which are interconnected via short fold lines, wherein additional material recesses (slits) are provided in the longitudinal region of the fold lines and the dimensions of the walls of the lining correspond substantially to the dimensions of the side walls of the external packaging.

FR 1 410 362 A discloses a folding box with an internally arranged corrugated cardboard unit. The folding box has side walls, lid tabs and base tabs. The corrugated cardboard unit likewise has side walls and base tabs, of which the geometry corresponds to that of the side walls of the folding box. In this case, only three of the four base tab units of the corrugated cardboard unit are glued to the folding carton, wherein the folding procedure is carried out in such a way that two opposite narrow tabs are driven inwardly and two opposite wide tabs are driven outwardly, wherein one of the two tabs constitutes the tab that is not glued. Once the folding procedure is complete for the base, this unglued tab is turned over and glued so that a solid base is formed.

US 2009/286663 A1 discloses a robust box construction formed from a folding carton with an additional inner layer, which is particularly strong, and of which the objective is to allow a large number of boxes to be stacked one on top of the other. Inner inserts are also used, which, in the corner region, form a cavity with the outer wall of the corrugated cardboard unit.

SUMMARY OF THE INVENTION

Proceeding from the cited prior art, the object or technical problem of the present invention is to specify a folding box cutout of the type described in the introduction, which can be produced economically and also enables problem-free, time-saving handling and filling procedures compared to the known solutions.

The folding box cutout according to the invention is given by the features of independent claim 1. Advantageous embodiments and developments are given by the features of the claims dependent on independent claim 1.

The folding box cutout according to the invention is accordingly characterized in that, in the longitudinal edge region of those fold lines of which the adjacent regions are folded through 180° when folded into the flat transport state, the corrugated cardboard unit has a compressed edge region running in the longitudinal direction, that is to say an edge region of reduced cross-sectional thickness.

The folding box cutout according to the invention makes it possible for the product to be filled without difficulty once the cutout has been unfolded, since the corrugated cardboard unit, in this state, already lies against the inner wall of the respective wall units, and therefore the corrugated cardboard unit does not have to be inserted additionally, and therefore the folding box can be filled in a single processing step. Previously, the only solution was to introduce the corrugated cardboard unit separately into the unfolded folding box either before the product or with the product, which led to the above-mentioned problems in the prior art.

A particularly preferred embodiment of the folding box cutout according to the invention is characterized in that the corrugated cardboard unit is formed in one piece and likewise has fold lines in the region of the longitudinal fold lines of the wall units covered by said corrugated cardboard unit. This embodiment allows a particularly simple and advantageous unfolding procedure.

A particularly preferred embodiment of the folding box cutout according to the invention is characterized in that the corrugated cardboard unit also lies against the inner wall of the lid unit and base unit via base and/or lid and/or side corrugated cardboard tab units, wherein the corrugated cardboard unit in each case has a fold line running parallel over the lid fold line and/or the base fold line over the upper or lower edge respectively.

A in terms of rational production and folding for transport in a flat folded state is characterized in that the corrugated cardboard unit is connected rigidly, in particular glued, to at least one wall unit.

An embodiment that is particularly advantageous in terms of practical unfolding is characterized in that the cross-sectional thickness of the corrugated cardboard unit lies in the range between 1 to 3 mm (millimeters), and in particular is designed as what is known as an E-type or F-type. Greater or smaller cross-sectional thicknesses are possible without difficulty.

A particularly advantageous embodiment of the folding cutout box according to the invention is characterized in that there is no corrugated cardboard material of the corrugated cardboard unit in the inner wall region, which, in the closed state of the unfolded folding box, is arranged adjacent to an inserted lid tab or base tab, that is to say the corrugated cardboard unit has an outwardly open recess in each case. Since there is no corrugated cardboard material in the region of the lid tab or base tab in the inserted region, the procedure of inserting the base insert tab and lid insert tab during the unfolding procedure and during closure is particularly simple.

In a particularly advantageous embodiment, which ensures particularly economical production and, at the same time, a particularly simple manufacturing procedure in respect of the flat folding and unfolding processes, this embodiment is characterized in that the one-piece corrugated cardboard unit is attached, in particular glued, merely to a single wall unit.

Further advantages and features of the invention are to be inferred from the features further disclosed in the claims and from the following exemplary embodiments.

BRIEF DESCRIPTION OF THE DRAWINGS

The invention will be described and explained in greater detail hereinafter on the basis of the exemplary embodiments illustrated in the drawing, in which.

DETAILED DESCRIPTION OF THE INVENTION

Embodiments of the Invention

Figure 1:
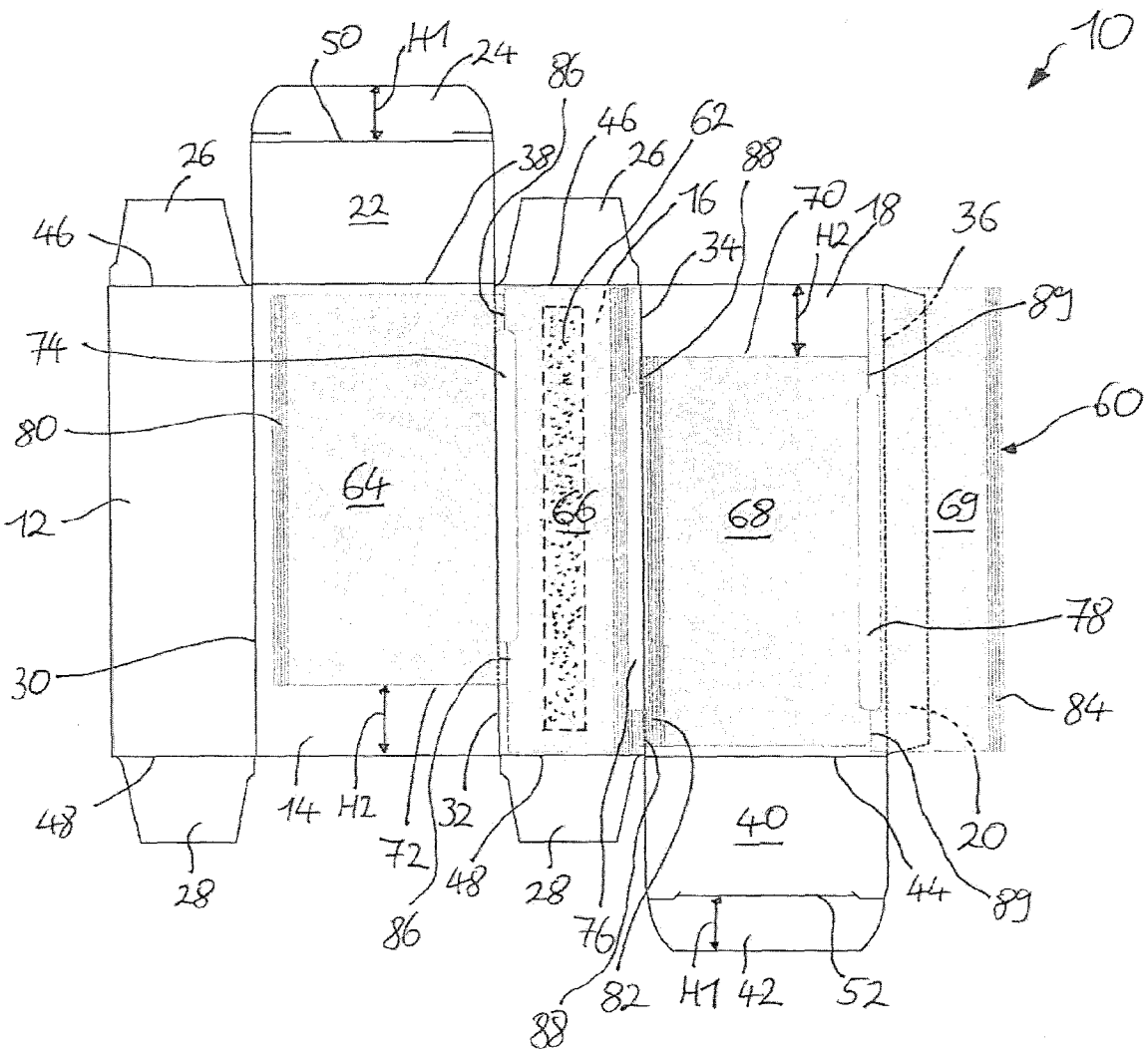
FIG. 1 is a schematic plan view of a folding box cutout comprising a one-piece corrugated cardboard unit connected, in some areas, to the inner wall.

An exemplary embodiment of a folding box cutout 10, which forms a cuboid folding box in the unfolded state, is illustrated in the figures.

The folding box cutout has a first side wall unit 12, which is connected to a front wall unit 14 via a longitudinal fold line 30, wherein the front wall unit 14 is connected to a second side wall unit 16 via a second longitudinal fold line 32, the second side wall unit 16 is connected to a rear wall unit 18 via a third longitudinal fold line 34, and a longitudinal edge glued tab 20 is attached to the free edge of the rear wall unit 18 via a fourth longitudinal fold line.

The wall units have the same height and have merely different widths.

An upper side tab 26 is attached to the first side wall unit 12 at the upper side via an upper side tab fold line 46, and a lower side tab 28 is attached to the first side wall unit 12 at the lower side via a lower side tab fold line 48.

A lid unit 22 is attached to the front wall unit 14 at the upper side via a lid fold line 38, a lid insert tab 24 being attached to the free edge of said lid unit at the upper side thereof via a lid insert tab fold line 50.

An upper side tab 26 is attached to the second side wall unit 16 at the upper side via an upper side tab fold line 46, and a lower side tab 28 is attached to the second side wall unit 16 at the lower side via a lower side tab fold line 48.

A base unit 40 is attached to the rear wall unit 18 at the lower side via a base fold line 44 and, in its lower free end region, has a base insert tab 42 attached via a base insert tab fold line 52.

On the underside facing away from the viewer of FIG. 1, the longitudinal edge glued tab 20 has a glued region which continues substantially over the entire length and which is suitable for connection, in some areas, to the edge region of the inner wall of the first side wall unit 12, so that a flat folded folding box can be produced, which can be unfolded in a simple manner.

The folding box cutout 10 according to the invention is characterized in that a corrugated cardboard unit 60 is present on the inner wall of the wall units and is connected, at least in some areas, to the inner wall and thus ensures a unit that can be handled as one piece for folding into the flat transport state and for folding into the unfolded state of a folding box, without having to additionally insert a corrugated cardboard unit with the product once the folding box has been unfolded, as was conventional in the prior art. In other words, this means that, once the folding box has been unfolded, the complex procedure of the additional prior insertion of a corrugated cardboard unit and subsequent introduction of the product, or the introduction of a corrugated cardboard unit together with the product can be omitted, and also that the associated problems no longer occur. Merely the product still has to be introduced.

The corrugated cardboard unit 60 has a first region 64, which covers the inner wall region of the front wall unit 14 with the exception of an offset H2 at the lower side, said offset being slightly greater than the height H1 of the base insert tab 42. The first region 64 is coupled via a first corrugated cardboard fold line 86 to a second region 66, which has substantially the surface area of the second side wall unit 16. This second region 66 is connected to the inner wall of the second side wall unit 16 via a glued area 62. In the region of the second longitudinal fold line 32, the corrugated cardboard unit 60 has a first slitted recess 74 between the first region 64 and the second region 66, said slitted recess extending over large areas of the second longitudinal fold line 32, but still ensuring a connection between the first region 64 and the second region 66 via the first corrugated cardboard fold line 86 in the upper edge region and lower edge region.

The second region 66 of the corrugated cardboard unit 6 is connected to a third region 68 of the corrugated cardboard unit via a second corrugated cardboard fold line 88, wherein, in this case too, a second closed slitted recess 76 is present along the third longitudinal fold line 34 and the third region 68 is attached to the second region 66 via a second corrugated cardboard fold line 88 present in the corrugated cardboard unit 60 at the upper side and lower side.

A further third closed slitted recess 78 is present in the right-hand longitudinal side region of the third region 68 of the corrugated cardboard unit 60 in FIG. 1 and runs parallel to the fourth longitudinal fold line 36 in the direct vicinity thereof, wherein a fourth region 69 is attached to the third region 68 via a third corrugated cardboard fold line 89.

At the upper side, the third region 68 of the corrugated cardboard unit 60 has an offset of height H2 with respect to the upper edge of the rear wall unit 18, wherein the height H2 is slightly greater than the height H1 of the lid insert tab 50.

The described corrugated cardboard unit 60 is thus connected in one piece to the folding box cutout 10 via the glued area 62, wherein the individual regions 64, 66, 68, 69 of said corrugated cardboard unit are designed in terms of surface area such that they largely cover the inner wall of the front wall unit 14, on the first side wall unit 12, the front wall unit 14, the second wall unit 16 and the rear wall unit 18 in the folded state.

The offset region of the first region 64 of the corrugated cardboard unit 60 and of the third region 68 of the corrugated cardboard unit 60 is referred to as a lower recess 72 and as an upper recess 70 respectively with respect to the free edge of the folding box cutout H2 in FIG. 1.

The closed slitted recesses 74, 76, 78 are used to ensure a facilitated folding procedure into the flat folded transport state, without the flat folded folding box cutout 10 having an increased overall height. Compression regions 80, 82, 84 present on the corrugated cardboard unit 60, which ensure that the folding box cutout 10 has a small cross-sectional height in the flat, folded together transport state, run in the same target direction. The compressed regions are arranged in a region parallel to the longitudinal edges of the corrugated cardboard unit 60, more specifically at the longitudinal edges involved when folding through 180 degrees (transport state). The first region 64 thus has a first compression region 80 in its left-hand edge region in FIG. 1, said compression region running over the entire longitudinal edge of said first region, as is also the case with conventional compression regions, and entails a cross-sectional reduction of the folding box cutout in the flat folded transport state. A second compression region 82 is further present continuously along the longitudinal side, parallel to the closed second slitted recess 76, to the right and left thereof, and reduces the cross-sectional thickness of the corrugated cardboard unit 60 in this region, wherein the folding box cutout 10 is folded through 180 degrees along the third longitudinal fold line 34 in the flat folded state.

Lastly, a third compression region 84 is present in FIG. 1 in the right-hand free longitudinal edge region of the corrugated cardboard unit 60 of the third region 68 and, in the folded state of the folding box cutout 10, comes to rest in the region of the first compression region 80 or the first longitudinal fold line 30, so as to thus also enable a low cross-sectional height in the flat folded state.

With the folding box cutout 10 according to the invention comprising a corrugated cardboard unit 60 that can be handled as one piece, it is easily possible, without additional effort, to create a folding box that enables a corrugated cardboard unit 60 arranged peripherally internally for additional protection of the introduced product, wherein folding in the flat transport state is ensured on the one hand, and the additional insertion of a corrugated cardboard unit 60 can be omitted on the other hand.

Figure 2:
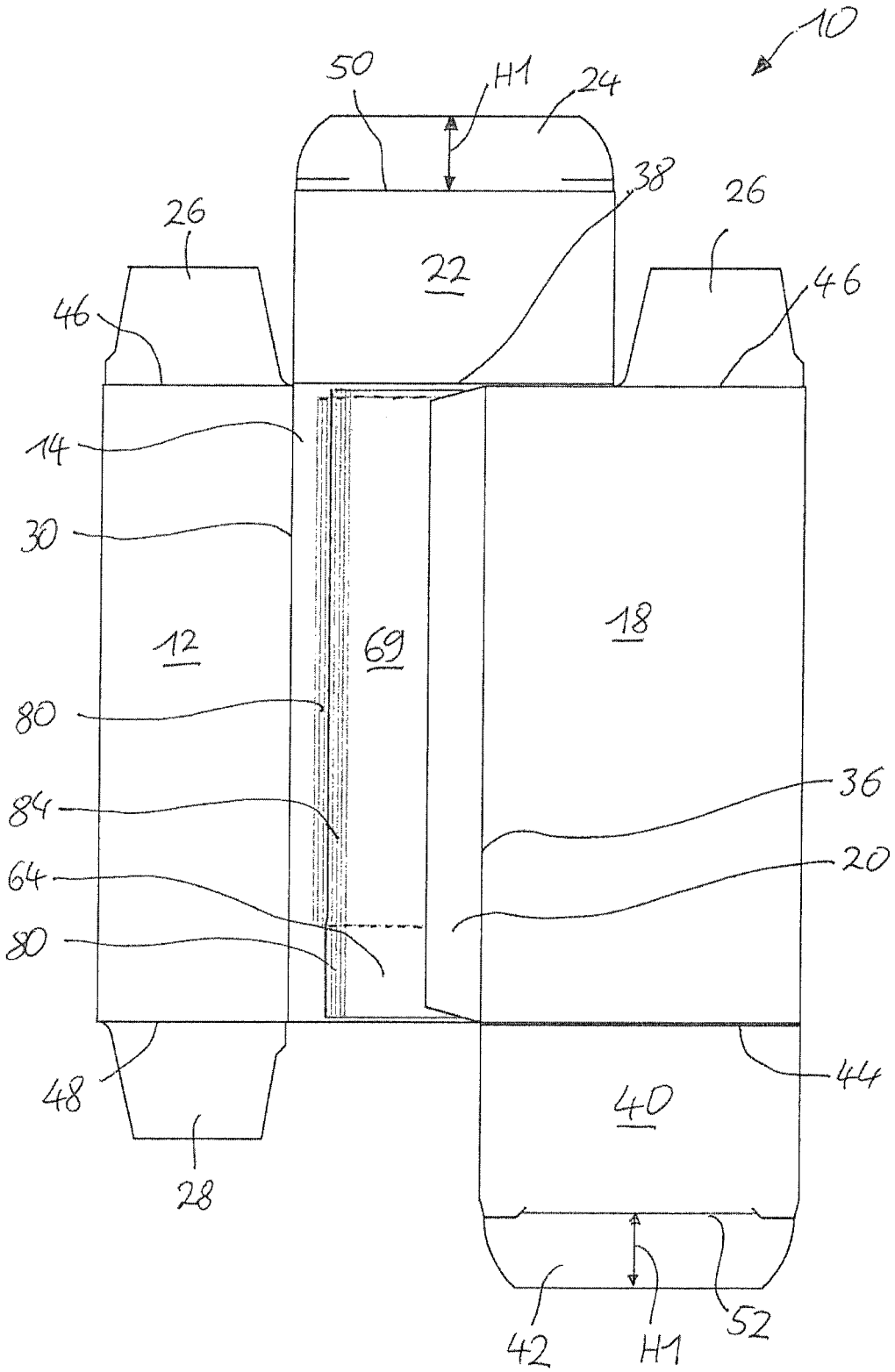
FIG. 2 is a schematic plan view of the folded state of the folding carton cutout according to FIG. 1 in view of the flat transport state after a first folding procedure.

FIG. 2 shows a first step for folding the folding box cutout 10 into a flat transport state. To this end, the rear wall unit 18 is folded in a simple manner through 180 degrees about the third longitudinal fold line 34, this state being illustrated in FIG. 2.

Figure 3:
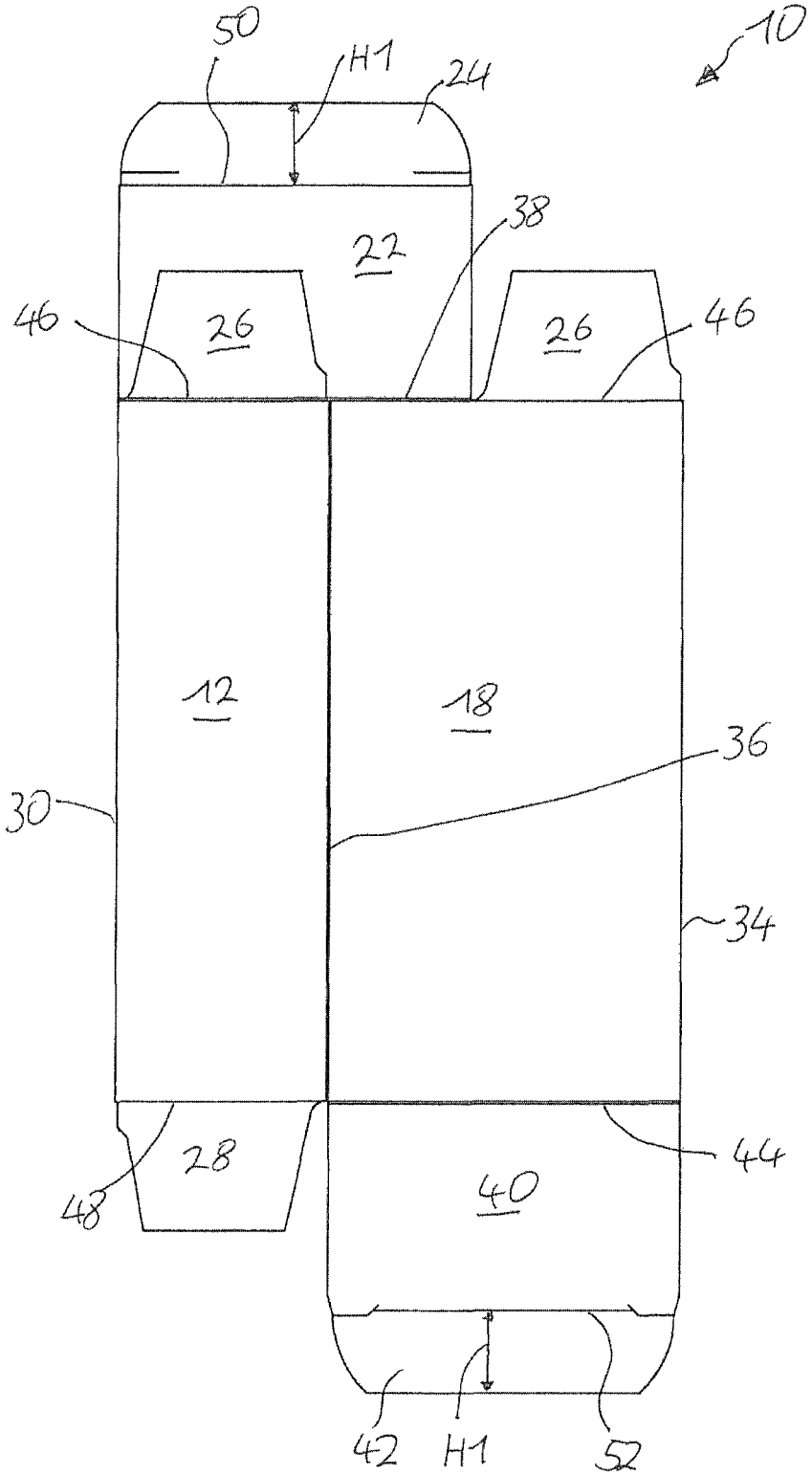
FIG. 3 is a schematic plan view of the folded folding carton cutout according to FIG. 1 in the transport state, FIGS. 4*a, b* are a schematic section through an unfolded folding box having a carton cutout according to FIG. 1 along a line of section I-I according to FIG. 3 in the flat folded state (FIG. 4*a*) and unfolded state (FIG. 4*b*)
Figure 4:
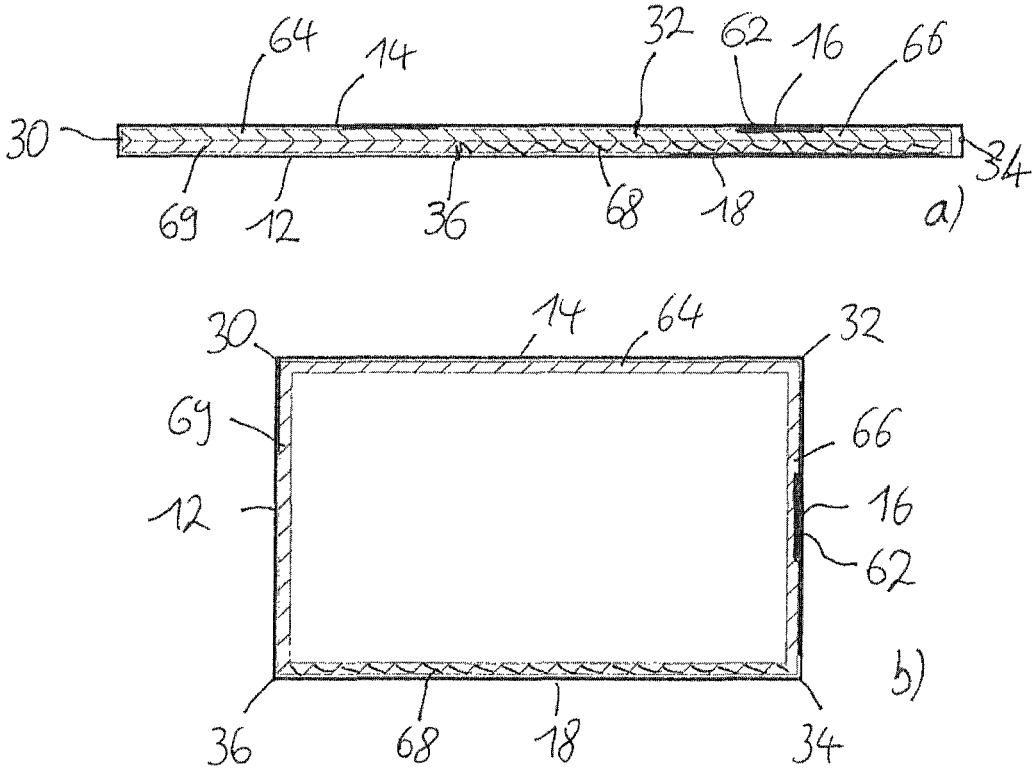

The first side wall unit 12 is then folded through 180 degrees about the first longitudinal fold line 30, wherein the inner face of the first side wall unit 12 comes into contact with the glued area present on the longitudinal wall glued tab 20 and a compact, flat folded folding box is provided (see FIGS. 3 and 4).

Figure 5:
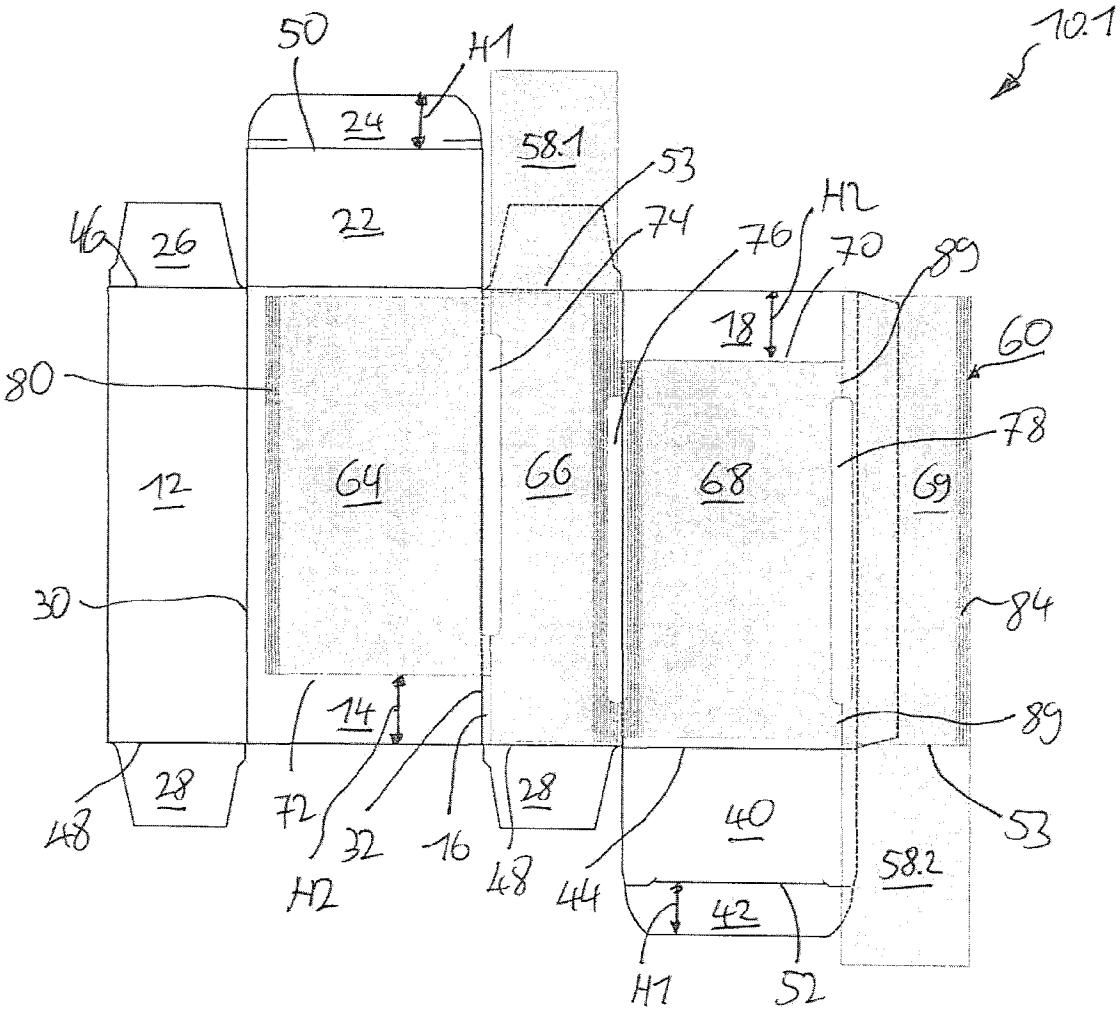
FIG. 5 is a schematic plan view of a folding box cutout comprising a one-piece corrugated cardboard unit connected, in some areas, to the inner wall, in each case with an additional upper and lower side corrugated cardboard tab unit.
Figure 6:
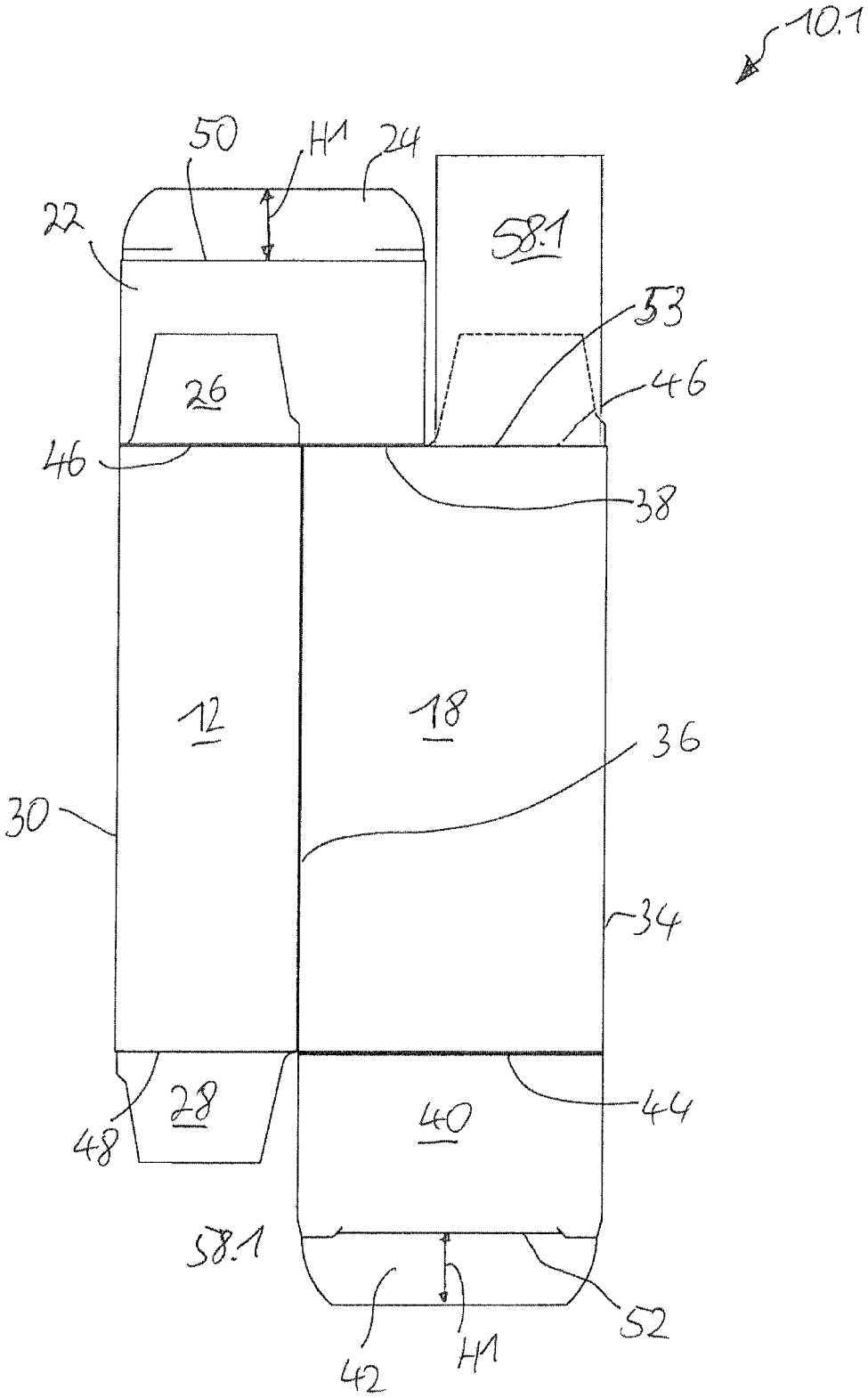
FIG. 6 is a schematic plan view of the folded state of the folding carton cutout according to FIG. 5 in terms of the flat transport state after a first folding procedure.

The flat folded folding box cutout 10 according to FIG. 3 is erected in a simple manner at the filler, for example by exerting pressure onto the first longitudinal fold line 30 and onto the third longitudinal fold line 34, and thus achieves the unfolded state illustrated in cross section in FIGS. 5 and 6. The product to be filled, for example a perfume bottle, can then be introduced easily, and is then relatively protected against mechanical load within the folding box due to the corrugated cardboard unit 60 present.

There is no example in the prior art of the inventive concept of connecting a folding box cutout to a corrugated cardboard unit, which can be handled as one piece during the folding procedure, so as to fold the folding box cutout into a flat transport state and into an unfolded state. As a result of this embodiment according to the invention, it is possible to ensure economic production of folding boxes of this type with additional protection for the product to be filled and, additionally, to dispense completely at the filler with costly measures for introducing protection of this type.

In exemplary embodiments that are not illustrated, it is also possible to directly connect the inner wall of the side wall unit, the front wall unit, the rear wall unit, the lid unit or the base unit to separate corrugated cardboard units in each case, so that a unit that can be handled as one piece is also produced in this case.

Three further variants of a folding box cutout 10.1 (FIGS. 5 and 6), 10.2 (FIGS. 9 and 10) and 10.3 (FIGS. 7 and 8) are illustrated in FIGS. 5 to 10. These differ from the above-described folding box cutout in that the corrugated cardboard unit 60 lies against the inner wall of the lid unit 22 and base unit 40, even in the folded state. Like components bear like reference signs and will not be explained again.

In the exemplary embodiment according to FIGS. 5 and 6, a side corrugated cardboard tab unit 58.1, of which the length corresponds substantially to the width of the lid unit 22, is formed integrally on the second region 66 at the upper side via a fourth corrugated cardboard fold line 53. A side corrugated cardboard tab unit 58.2, which has a length that corresponds to the width of the lid unit 22, is formed integrally on the fourth region 69 at the lower side via a fourth corrugated cardboard fold line 53.

Figure 7:
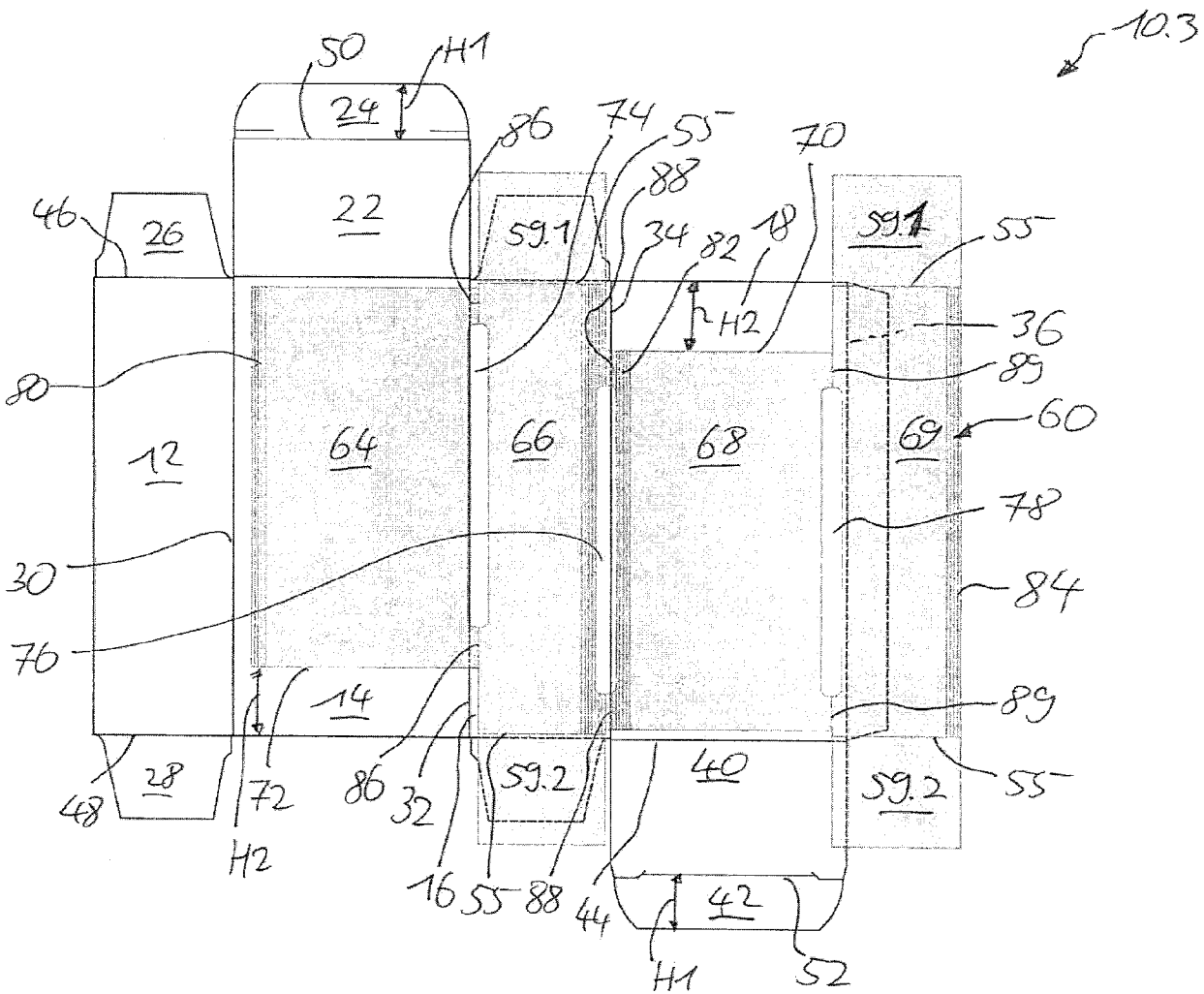
FIG. 7 is a schematic plan view of a folding box cutout comprising a one-piece corrugated cardboard unit connected, in some areas, to the inner wall, in each case with two additional upper and lower side corrugated cardboard tab units.
Figure 8:
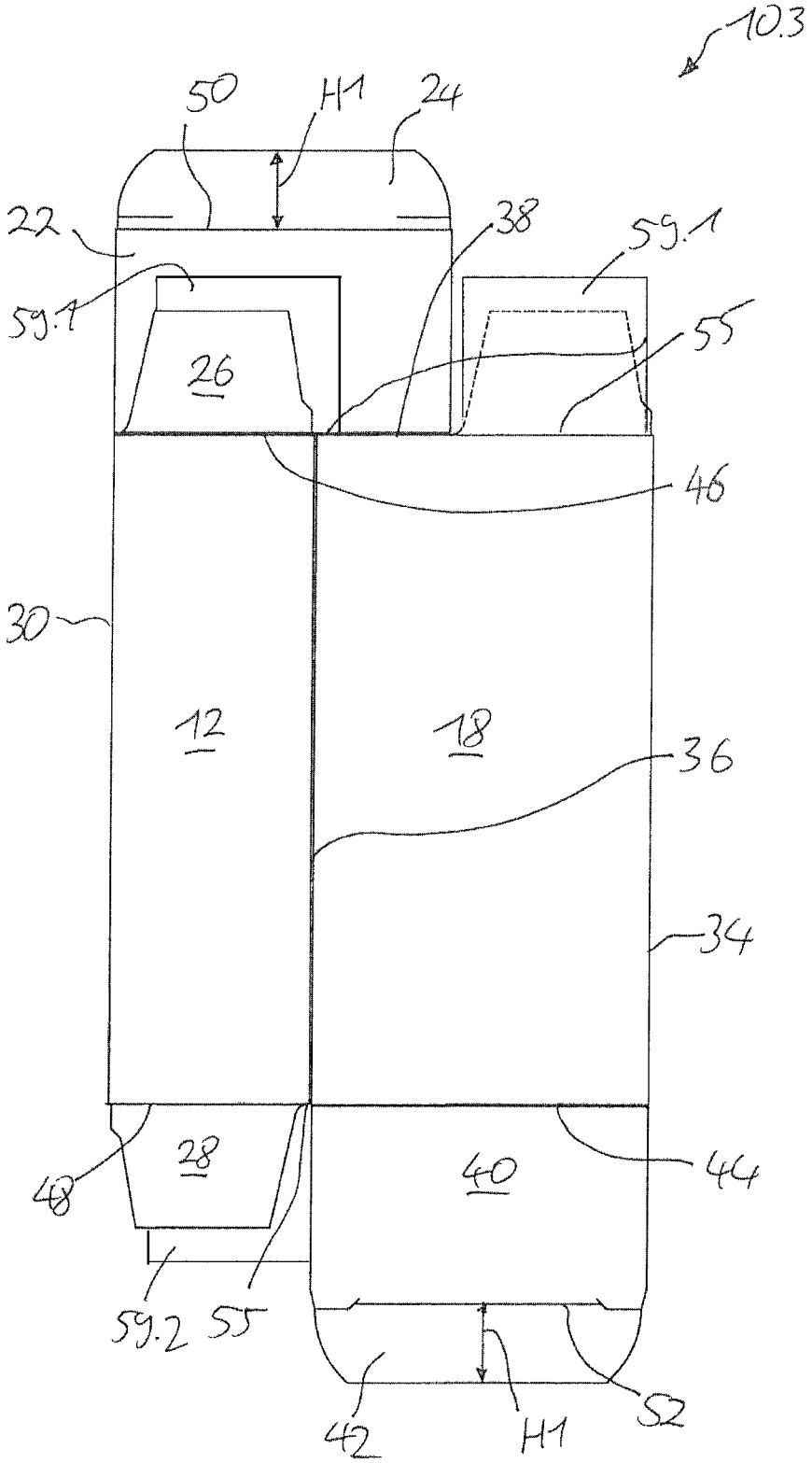
FIG. 8 is a schematic plan view of the folded state of the folding carton cutout according to FIG. 7 in terms of the flat transport state after a first folding procedure.

The second variant according to FIGS. 7 and 8 has a side corrugated cardboard tab unit 59.1 and 59.2, of which the length corresponds to approximately half the width of the lid unit 22 and of the base unit 40 respectively, said side corrugated cardboard tab units being attached both to the second region 66 and to the fourth region 69 on the upper side via a fifth corrugated cardboard fold line 55.

Figure 9:
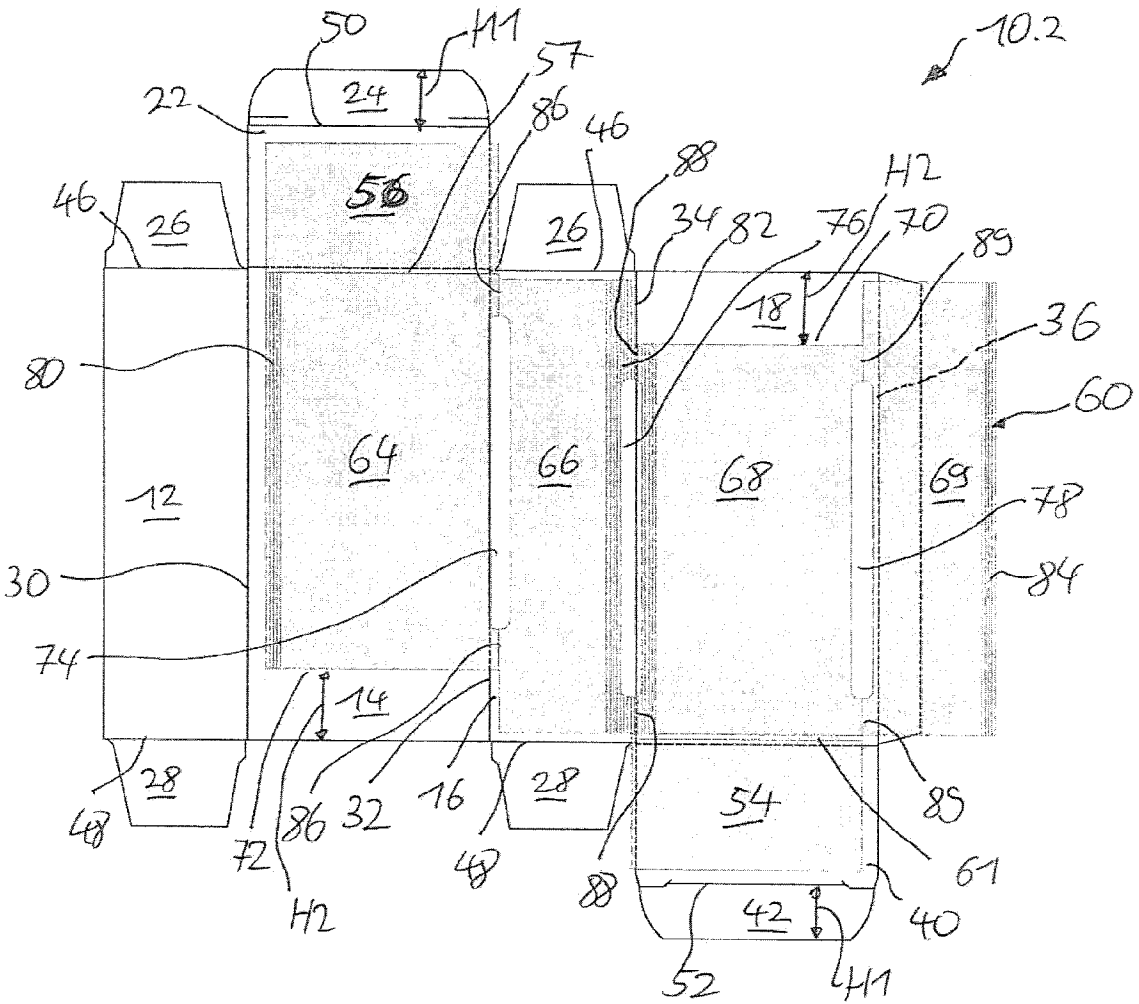
FIG. 9 is a schematic plan view of a folding box cutout comprising a one-piece corrugated cardboard unit connected, in some areas, to the inner wall, with an additional base corrugated cardboard tab unit and lid corrugated cardboard tab unit.
Figure 10:
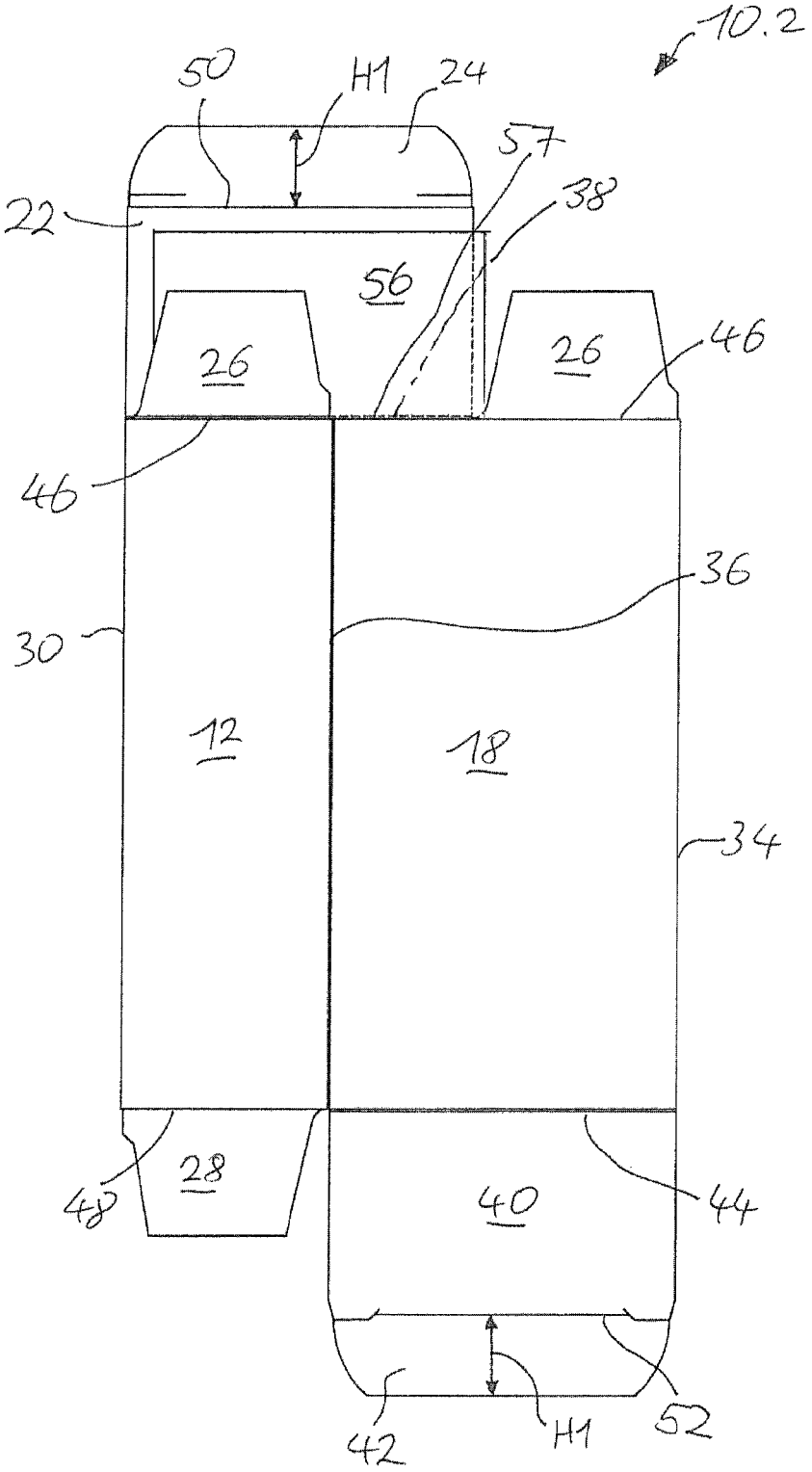
FIG. 10 is a schematic plan view of the folded state of the folding carton cutout according to FIG. 9 in terms of the flat transport state after a first folding procedure.

Lastly, a third variant is illustrated in FIGS. 9 and 10, in which a lid corrugated cardboard tab unit 56 is attached in the first region 64 of the corrugated cardboard unit 60 on the upper side via a sixth corrugated cardboard fold line 57, the surface area of said lid corrugated cardboard tab unit corresponding substantially to the surface area of the lid unit 22. A base corrugated cardboard tab unit 54 is formed integrally on the third region 68 of the corrugated cardboard unit 60 at the lower side via a seventh corrugated cardboard fold line 61, the surface area of said base corrugated cardboard tab unit corresponding substantially to the surface area of the base unit 40.

The invention claimed is:

1. A folding box cutout, comprising wall units with inner walls that can be folded along longitudinal fold lines, a lid unit that can be folded about a lid fold line, and a base unit that can be folded about a base fold line, wherein, in a flat transport state, the folding box cutout is folded to form a flat folding box, which can be erected, filled and closed by the lid unit and by the base unit, a corrugated cardboard unit lies against the inner walls of the wall units and is connected, at least in some areas, to an inner wall, so that the wall units and the corrugated cardboard unit form a unit that can be handled as one piece during folding and unfolding of the folding box cutout, and the corrugated cardboard unit is present on each inner wall of the wall units, at least in some areas on the wall units, in particular peripherally, once the flat folded folding box has been erected, and in a longitudinal edge region of the longitudinal fold lines of which the adjacent regions are folded through 180° when folded into the flat transport state, the corrugated cardboard unit has a flat compressed edge region wider than the longitudinal fold lines and running in the longitudinal direction, that is to say an edge region of reduced cross-sectional thickness.

2. The folding box cutout as claimed in claim 1, wherein, the corrugated cardboard unit has fold lines in a region of the longitudinal fold lines of the wall units covered by said corrugated cardboard unit.

3. The folding box cutout as claimed in claim 2, wherein, the corrugated cardboard unit also lies against the inner wall of the lid unit and base unit via base and/or lid and/or side corrugated cardboard tab units, and the corrugated cardboard unit in each case has a fold line running parallel over the lid fold line and/or the base fold line over the upper or lower edge respectively.

4. The folding box cutout as claimed in claim 1, wherein, the corrugated cardboard unit is connected rigidly to at least one wall unit, and in particular is glued thereto at least in some areas.

5. The folding box cutout as claimed in claim 1, wherein, the cross-sectional thickness of the corrugated cardboard unit lies in the range between 1 and 3 mm.

6. The folding box cutout as claimed in claim 1, wherein, there is no corrugated cardboard material of the corrugated cardboard unit in the inner wall region, which, in the unfolded state of the folding box, is arranged adjacent to an inserted lid tab or base tab, the corrugated cardboard unit having an outwardly open recess in each case.

7. The folding box cutout as claimed in claim 2, wherein, the corrugated cardboard unit is glued to one wall unit.

8. The folding box cutout as claimed in claim 1, wherein, the corrugated cardboard unit is formed as a laminated corrugated unit in accordance with the E-type or F-type.

9. The folding box cutout as claimed in claim 1, wherein, the wall units of the folding box cutout further comprise a first side wall unit, a front wall unit, a second side wall unit and a rear wall unit, and the corrugated cardboard unit has a first wall region, which lies against the inner wall of the front wall unit, has an adjoining second wall region, which is attached, in particular glued, to the inner wall of the second side wall unit, an adjoining third wall region, which lies against the inner wall of the rear wall unit, and an adjoining fourth wall region, which lies against the inner wall of the first side wall unit in the folded state.

* * * * *